US005090482A

United States Patent [19]

Baron et al.

[11] Patent Number: 5,090,482

[45] Date of Patent: Feb. 25, 1992

[54] METHOD AND APPARATUS FOR EXTINGUISHING FIRES

[75] Inventors: Reuven Baron, Haifa; Esther Jacobson, Tel Aviv; Yechiel Spector, Zahala, all of Israel

[73] Assignee: Spectronix Ltd., Tel-Aviv, Israel

[21] Appl. No.: 633,824

[22] Filed: Dec. 26, 1990

[30] Foreign Application Priority Data

| | | | |
|---|---|---|---|
| Jan. 3, 1990 | [IL] | Israel | 92951 |
| May 11, 1990 | [IL] | Israel | 94367 |
| Aug. 31, 1990 | [IL] | Israel | 95543 |

[51] Int. Cl.[5] ..... A62C 3/00; A62C 3/06

[52] U.S. Cl. ..... 169/46; 169/44; 169/47; 169/54; 169/66; 169/91; 169/56

[58] Field of Search ..... 169/43, 44, 46, 47, 169/91, 54, 56, 61, 66, 68, 70, 30, 11, 14, 15

[56] References Cited

U.S. PATENT DOCUMENTS 2,477,947 8/1949 Yadoff ..... 169/43 X

FOREIGN PATENT DOCUMENTS 3281667 11/1988 Japan ..... 169/46

*Primary Examiner*—Margaret A. Focarino
*Assistant Examiner*—James M. Kannofsky
*Attorney, Agent, or Firm*—Benjamin J. Barish

[57] ABSTRACT

A method of extinguishing a fire by generating an intense electric field and/or a gaseous plasma constituted of a body of electrically-charged particles, and directing the electric field and/or plasma to the base of the fire until the fire is extinguished.

30 Claims, 9 Drawing Sheets

FIG 13
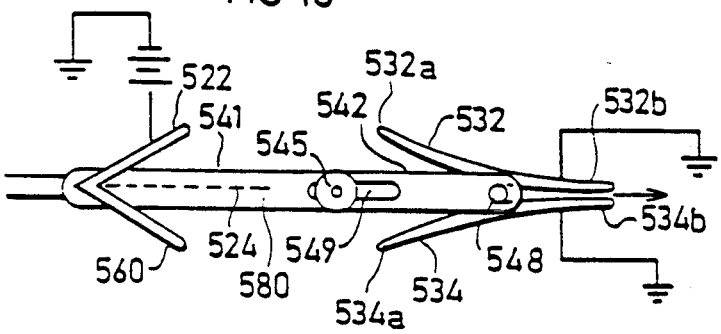
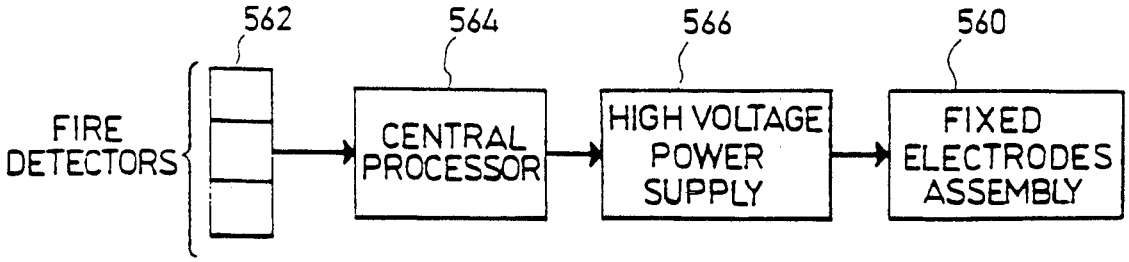
FIG 14

METHOD AND APPARATUS FOR EXTINGUISHING FIRES

FIELD AND BACKGROUND OF THE INVENTION

The present invention relates to a method and apparatus for extinguishing fires.

The existing methods and apparatus for extinguishing fires generally extinguish the fire by inhibiting the oxygen or fuel to support the fire, by cooling the area in which the combustion is taking place, and/or by interfering in the chain reactions involved in the combustion. However, the existing methods and apparatus generally suffer from one or more of the following drawbacks: damage to the equipment; pollution of the environment; hazards to the operating personnel; high rate and high cost of false alarms; noise; and limited number of operations before replacement or refilling is required.

OBJECTS AND BRIEF SUMMARY OF THE INVENTION

An object of the present invention is to provide a novel method, and also a novel apparatus, for extinguishing a fire having advantages in one or more of the above respects.

According to the present invention, there is provided a method for extinguishing a fire characterized in generating an intense electric field and/or a gaseous plasma constituted of a body of electrically-charged particles; and directing the electric field and/or plasma to the base of the fire until the fire is extinguished.

A "plasma" is a collection of electrically-charged particles, about equal in number or density, that is produced when the atoms in a gas become ionized. It is sometimes referred to as the fourth state of matter, to be distinguished from the solid, liquid and gaseous states.

When an intense electric field is produced between two electrodes at low atmospheric pressure, a glow discharge occurs between the two electrodes. Such glow discharges are responsible for the light given off by neon tubes and fluorescent lamps that operate by virtue of the plasmas that they produce in an electric discharge. Another form of glow discharge is called a corona discharge, generally occurring when one of the two electrodes has a shape causing the electric field at its surface to be significantly greater than that between the two electrodes. The corona discharge is usually evidence by a faint glow enveloping the high-field electrode and is often accompanied by streamers directed towards the low-field electrode. If the current through a glow discharge is increased, a stage is reached wherein the energy generated at the cathode is sufficient to provide all the conduction electrons directly from the cathode surface, rather than from gas between the electrodes. This new state of electric discharge is called an arc. Compared with the glow discharge, the arc discharge is a high-density plasma and will operate over a large range of pressures. By running a glow discharge or an arc between spaced electrodes and injecting gas into such a region, a hot, high-density plasma mixture is ejected, called a plasma jet. Such jets have many chemical and metallurgical applications.

The present invention is based on the known phenomenon that fire behaves as a plasma, and exploits this phenomenon by generating an intense electric field and/or an external plasma and causing the intense electric field or external plasma to interact with the "fire plasma" to suppress the combustion process.

A number of techniques are known for generating a plasma, including laser irradiation, and high energy electron bombardment in a gas. According to the preferred embodiments of the invention described below, however, the plasma is generated by applying a high voltage between two electrodes separated by an air gap. In the described preferred embodiments, the electrodes are configured such that the high voltage produces an intense electric field and/or a corona discharge between the two electrodes.

According to some embodiments of the invention described below, the intense electric field and/or plasma is directed to the base of the fire by initially fixing the plasma generator at a location which would be in the vicinity of the base of a fire should a fire occur. In other described embodiments, the intense electric field or plasma is directed to the base of the fire by mounting the electrodes on a portable unit and manually directing the generated electric field or plasma to the base of the fire.

According to further features in some of the described embodiments, a plasma is generated and the flow velocity of the plasma is increased by directing the plasma via a nozzle to the base of the fire. Another flowable medium may be injected into the generated plasma to produce a plasma jet which is applied to the base of the fire. The another flowable medium may be in the form of ionized or non-ionized particles, and may be or include a fire suppressant material.

The invention also provides apparatus for extinguishing a fire in accordance with the above method.

BRIEF DESCRIPTION OF THE DRAWINGS

The invention is herein described, by way of example only, with reference to the accompanying drawings, wherein:

FIG. 13 is a side view of the electrode assembly of FIG. 12; and FIG. 14 is a block diagram illustrating an automatic fire cooled system in accordance with the present invention.

DESCRIPTION OF PREFERRED EMBODIMENTS

Figure 1:
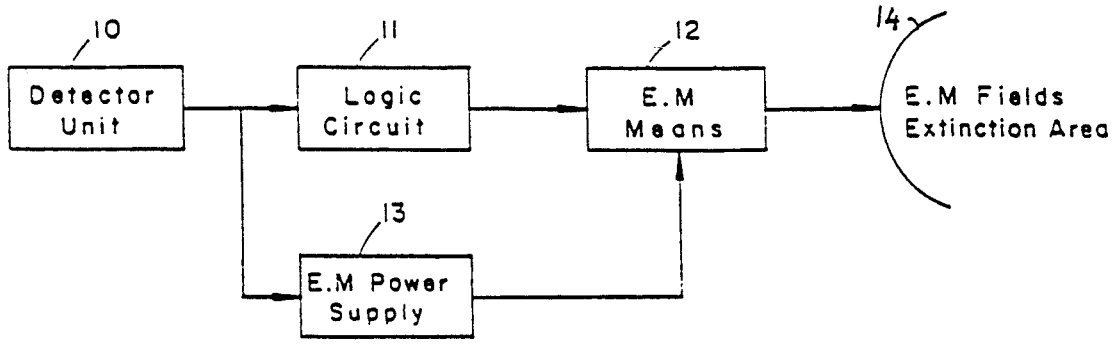
FIG. 1 is a block diagram illustrating a system according to the present invention.
Figure 2:
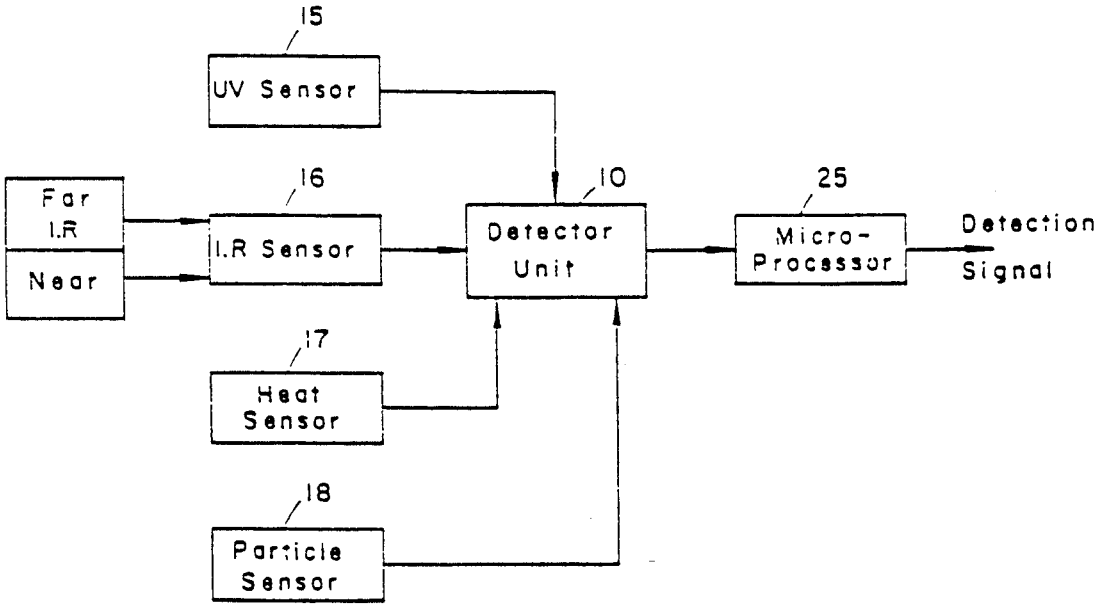
FIG. 2 is a block diagram more particularly illustrating the detector unit in the system of FIG. 1.
Figure 3:
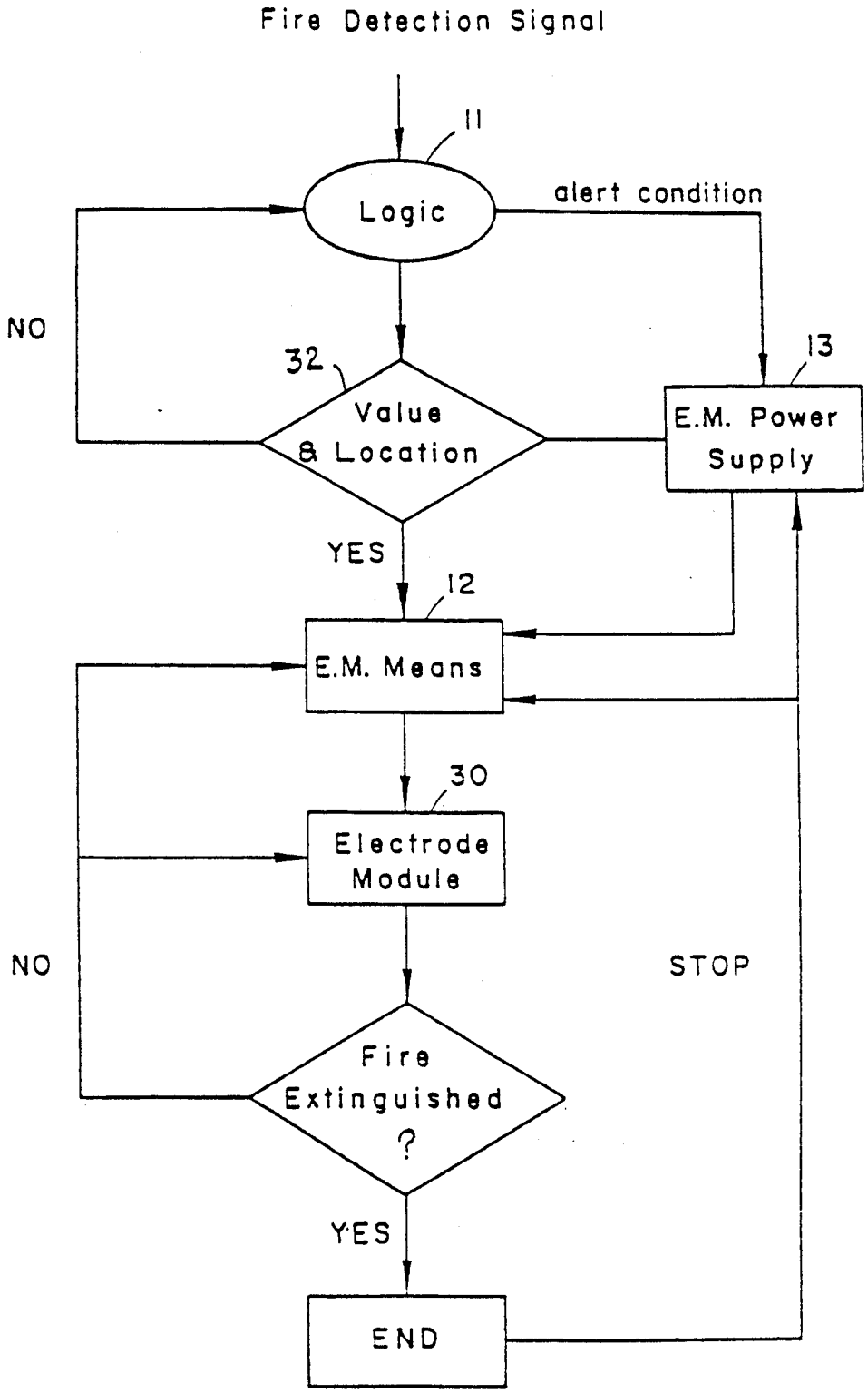
FIG. 3 is a flow diagram of a logic circuit for use in the system of FIG. 1.

The Embodiment of FIGS. 1-3

FIG. 1 is a block diagram of a fire control system according to the invention. A detector unit 10 is provided with at least one detector for detecting a respective property characteristic of a fire, and produces an output signal in response thereto. The output from the detector unit is fed to a logic circuit 11 which, when a fire is detected, produces an output signal to a high voltage (HV) driver 12 fed by a power supply 13 to electrodes 14 to produce an intense electric field which operates on the fire plasma. The intense electric field is applied to the base of the fire until the fire is extinguished.

As shown more particularly in FIG. 2, detector unit 10 comprises a plurality of sensors, including a UV (ultraviolet) sensor 15, an IR (infrared) sensor 16, a heat sensor 17, and a particle (e.g., soot or smoke) sensor 18. The IR sensor 16 may include two ranges of sensor elements, e.g., a far IR sensor indicated by block 16*a*, and a near IR sensor indicated by block 16*b*. The output of detector unit 10 in FIG. 2 is fed to a microprocessor 25, corresponding to the logic circuit 11 in FIG. 1, which determines whether the output from the detector unit 10 indicates a fire condition, and if so, it outputs a signal to the high voltage driver circuit (12, FIG. 1) and power supply (13, FIG. 1).

FIG. 3 is a flow diagram illustrating the operation of the logic circuit 11 of FIG. 1, or the microprocessor 25 of FIG. 2. The HV power supply 13 is normally OFF but upon receiving an output from the logic circuit 11, it goes to a STANDBY condition, and if the output is determined to indicate the occurrence of a fire, the HV power supply 13 is ENABLED to energize the HV driver circuit 12. This energizes the electrodes 14 and maintains them energized until the fire is extinguished, as indicated by block 30 in FIG. 3.

When large spaces are to be protected, the detector unit preferably includes a plurality of sensors, as indicated in FIG. 2, each monitoring a relatively small volume of the total space. The logic circuit 11 is adapted to analyze the outputs of the sensors and to determine whether the output of any one sensor indicates the occurrence of a fire at the respective location of the sensor, as indicated by block 32 in FIG. 3, such that the HV driver 12, and particularly the electrodes 14 driven thereby, are actuated only in the location in which a fire was sensed as having occurred.

Figure 4:
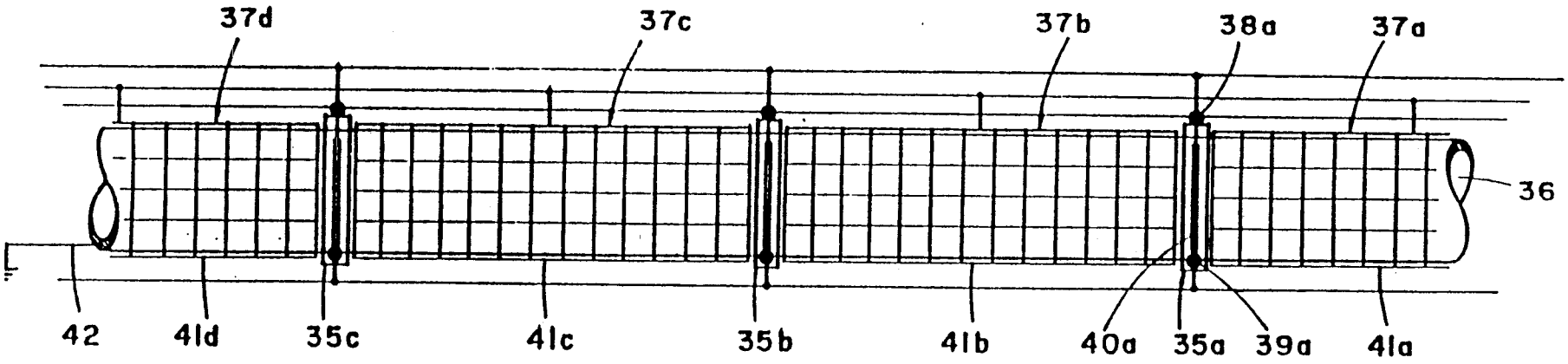
FIG. 4 is a pictorial illustration showing schematically a system according to the invention for controlling fires in distribution pipes.

The Embodiment of FIG. 4

FIG. 4 pictorially illustrates a fire control system for use in a distribution pipe 36 carrying an inflammmable fluid, such as oil. FIG. 4 illustrates a plurality of control units 35*a*, 35, 35*c*, each adapted to be coupled to the ends of pipe sections 37*a*, 37*b*, 37*c*, 37*d* of the pipe 36. Each control unit 35 comprises a tubular section of substantially the same diameter as the pipe 36, so as to be screw-fitted thereto. Each control unit includes one or more outer detectors 38*a*, and one or more inner detectors 39*a*, both connected to the central logic and power supply.

The electrodes for each section include an inner annular electrode 40*a* enclosed within its respective control unit (e.g., 35*a*), and an external electrode 41*a*, 41*b*, 41*c*, 41*d* in the form of a circular wire mesh enclosing the respective pipe section. The internal and external electrodes are connected to respective supply rails in the central logic and power supply. The distribution pipe 36 may be formed of an electrically-conductive material so as to constitute a ground electrode (42), connected to the central logic and power supply. If pipe 36 is of an electrically insulating material, a separate ground electrode would be provided between the external mesh electrodes 41*a*–41*d*, and the internal annular electrode 40*a*.

It will thus be seen that the system illustrated in FIG. 4 is able to detect the occurrence of a fire either internally or externally of each pipe section. If an internal fire is detected, a high voltage is applied between the internal electrode (40*a*) of the respective section and the ground 42; and if an external fire is detected, the high voltage is applied between the external electrode (41*a*–41*d*) for the respective section and the ground (42).

Figure 5:
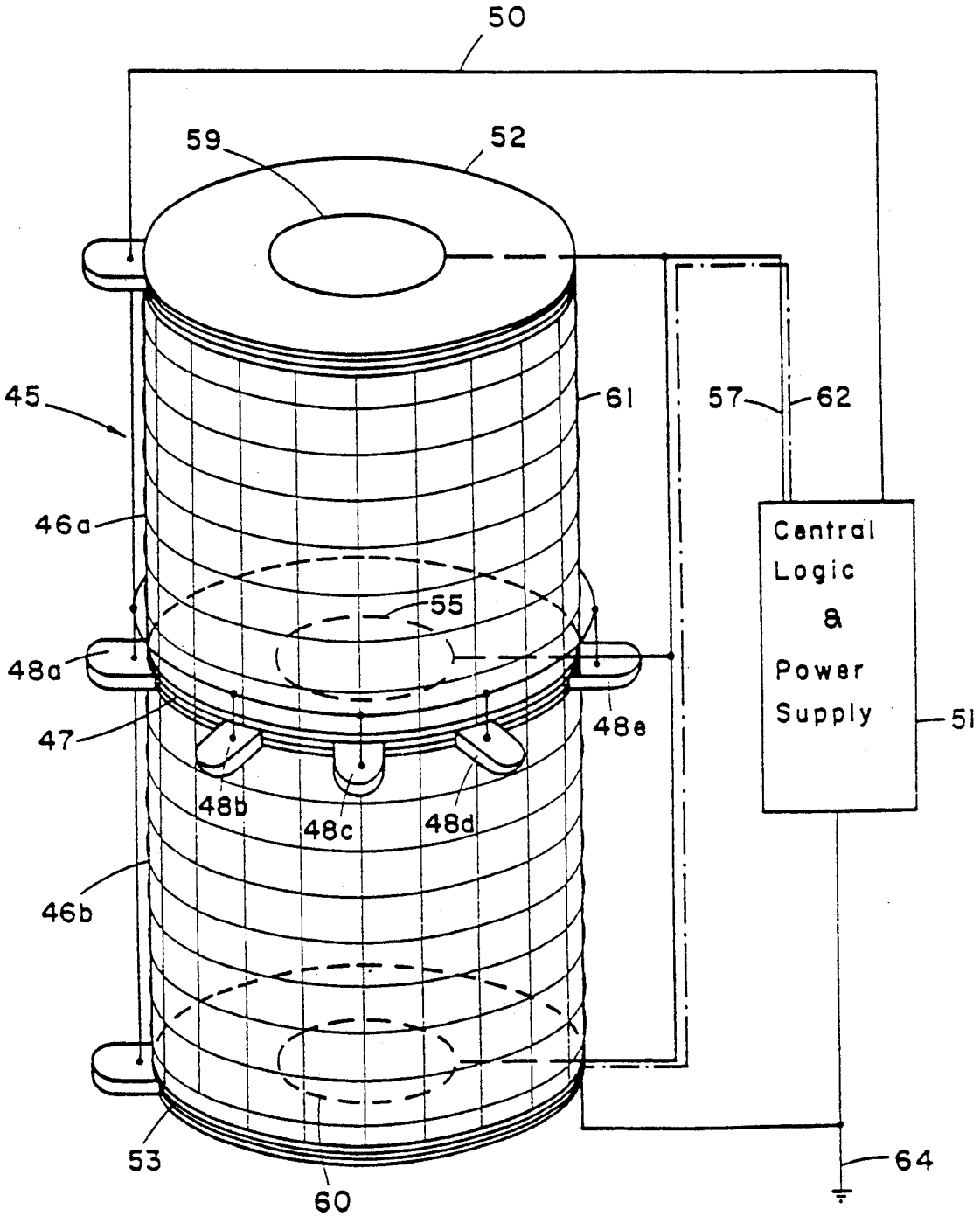
FIG. 5 is a pictorial illustration showing schematically a system according to the invention for controlling fires in storage vessels.

The Embodiment of FIG. 5

FIG. 5 illustrates the invention applied to protect from fire storage containers, such as drums containing inflammable liquids. Thus, the storage container illustrated in FIG. 5 is in the form of a substantially cylindrical storage tank 45 having two sections 46*a*, 46*b* interconnected by a control unit 47. Further control units 52, 53 may be provided at the opposite ends of the tank. Each control unit 47, 52, 53 may be of the construction as described with reference to FIG. 4.

The tank is further equipped with a plurality of external sensors 48*a*–48*e* distributed externally around the circumference of the tank, and one or more inner sensors (not shown) distributed internally of the tank. These sensors are connected via a bus 50 to a central logic and power supply unit 51.

Unit 51 controls the energization of a selected one of a plurality of inner annular electrodes 55, 59, 60, and an outer electrode 61, the latter being in the form of a wire mesh extending over the outer surface of the tank.

The central logic and power supply unit 51 is connected to the inner electrodes 55, 59, 60 via bus 57, and to the outer electrode 61 via bus 62.

It will thus be seen that the system illustrated in FIG. 5 will be able to detect the occurrence of a fire at any particular location of the tank, both externally and internally, and will automatically respond to apply a high voltage between the appropriate electrodes in order to generate the intense electric field applied to the base of the fire until the fire is extinguished.

Figure 6:
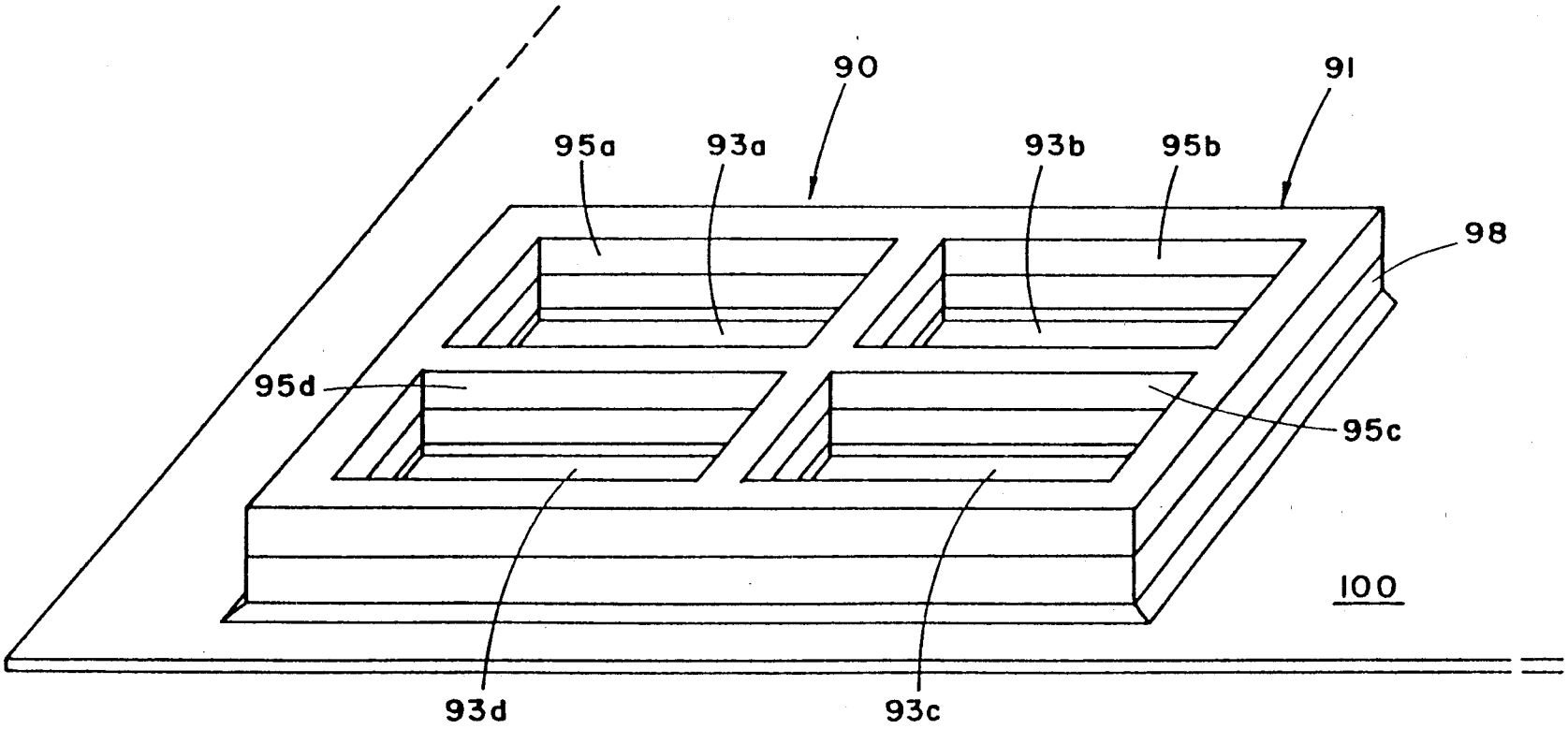
FIG. 6 is a pictorial illustration showing schematically a system for controlling fires resulting from spillages of inflammable material.

The Embodiment of FIG. 6

FIG. 6 illustrates the fire control system applied to a support platform 90 for supporting fuel pipes, storage drums, or other inflammable equipment, and is effective to extinguish a fire that may occur as a result of spillage of inflammable material on the support platform. Thus, the platform, indicated at 90 in FIG. 6, comprises a first electrode structure 91 formed of metal and having a plurality of apertures 93*a*–93*d* which define a like plurality of annular electrodes 95*a*–95*d*. Electrode structure 91 is insulated, by an identically-shaped insulating layer 98, from the ground plate 100 of electrically-conductive material Thus, in the event of a spillage, the inflammable liquid flows into the apertures of the support platform 90 so as to be encircled by one of the annular electrodes in the electrode structure 91, and in case a fire is detected, the HV power supply unit supplies a high voltage between the electrode structure 91 and the ground plate 100 to generate an intense electric field until the fire is extinguished.

It will thus be seen that the arrangement illustrated in FIG. 6 effectively sectionalizes any fire that may be caused by a spillage so that a large fire is reduced to a plurality of relatively small fires, each of which may be extinguished by the application of a high voltage pulse as described above.

Figure 7:
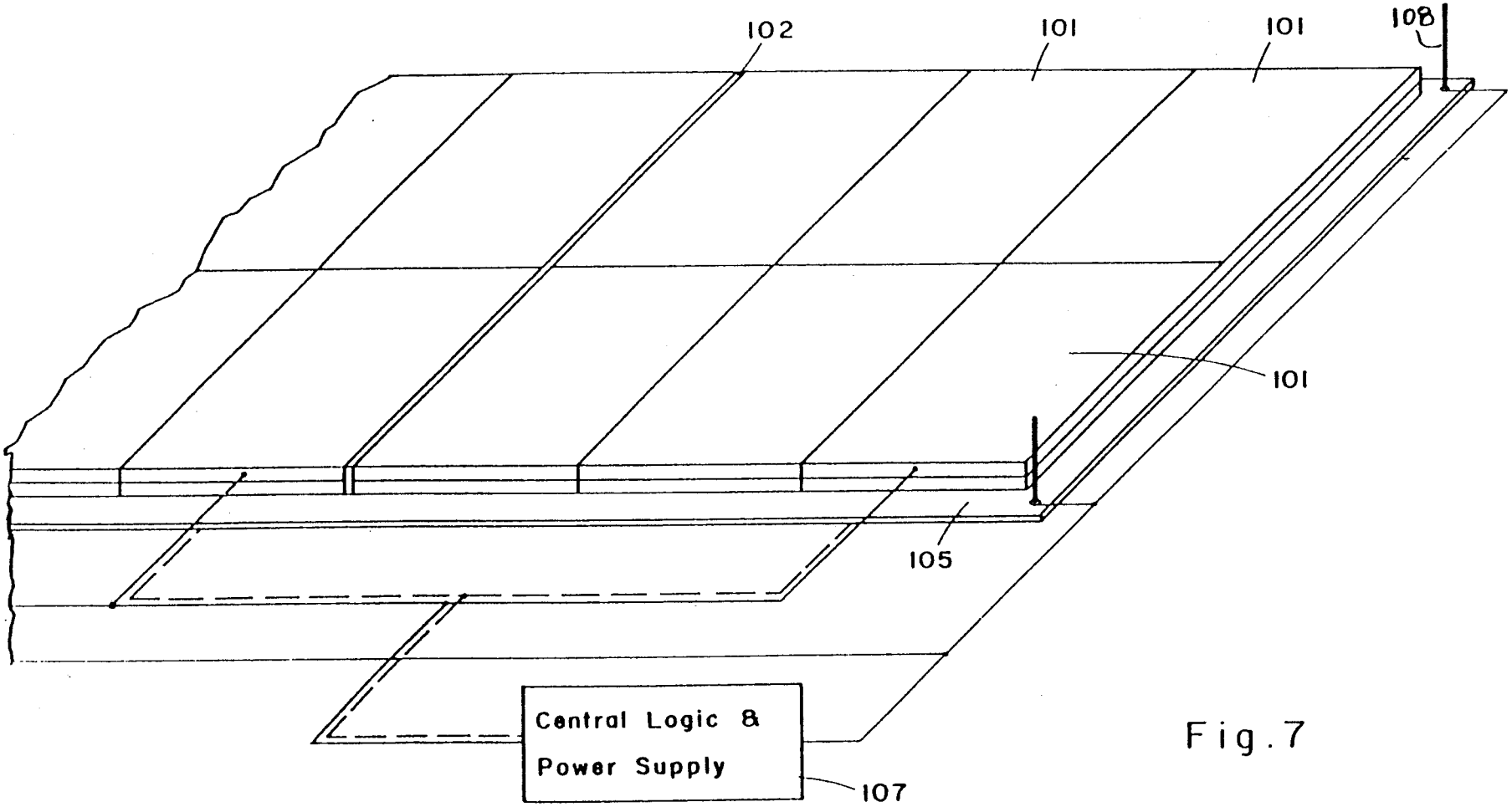
FIG. 7 is a pictorial illustration of the system shown in FIG. 6 when used on an enlarged scale.

The Embodiment of FIG. 7

FIG. 7 illustrates the system of FIG. 6 applied to protect a large area of storage space. Thus, a plurality of support assemblies 101 are connected end-to-end so that good electrical contact is established between adjacent pairs of the first electrode structures (91, FIG. 6). Discrete areas of floor space are covered in this manner, and between each discrete area of floor space the corresponding support assemblies are electrically insulated from each other by means of suitable insulation 102. The whole of the floor area is covered by a single ground plate 105 which, together with each of the electrode structures corresponding to 91 (FIG. 6), are connected to a central logic and power supply unit 107.

A plurality of detectors 108 monitor each section of floor area, so that in response to their outputs, the central logic and power supply 107 determines both the occurrence of a fire and its location. The latter unit then applies a high voltage pulse between the positive ground plate 105 and the negative annular electrode structure related to that section or sections where a fire has been detected.

Figure 8:
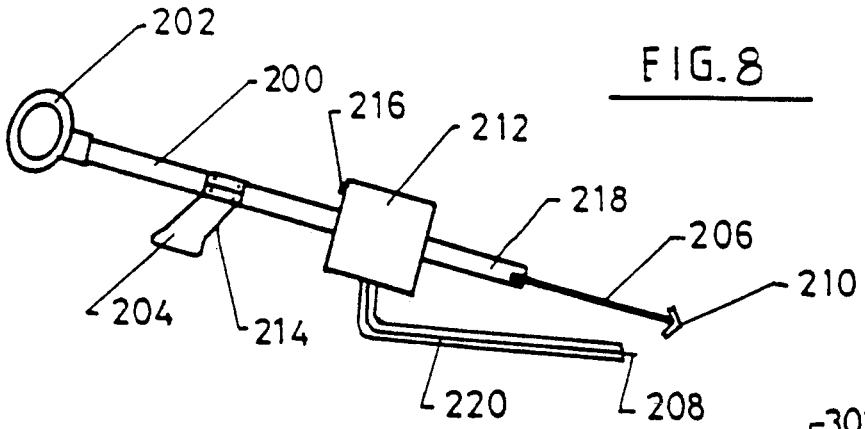
FIG. 8 illustrates another form of apparatus in accordance with the invention embodied in a portable, manually-actuated unit.

The Embodiment of FIG. 8

FIG. 8 illustrates a portable manually-actuated unit for use to extinguish a fire. Such a unit includes an elongated member, generally designated 200, carrying a first handgrip 202 at one end, and a second handgrip 204 adjacent to but inwardly of handgrip 202. Elongated member 200 also carries a pair of electrodes 206, 208 defining an airgap 210 at the opposite end, and a source of high voltage 212 at an intermediate location between handgrips 202, 204 and airgap 210.

The two handgrips 202, 204 thus constitute a handle adjacent one end of the elongated member 200 facilitating manually carrying the portable unit while the two handgrips are grasped by the two hands of the user. This enables the user to direct the airgap 210 to the base of the fire to be extinguished. Handgrip 204 includes an actuator button 214 which is manually depressed by the user in order to initiate the application of the high voltage from the high voltage source 212 across the airgap 210. The high voltage source 212 further includes an indicator lamp 216 which is energized whenever the high voltage source 212 is actuated by actuator button 214.

As one example, elongated member 200 may be an aluminum pipe of 2 cm diameter and of 110 cm length; the high voltage source 212 may be a high voltage generator producing about 25 kV and supplied by rechargeable batteries (e.g., nickel-cadmium) included within the high voltage source; and electrode 206 may be a steel rod of 5 mm diameter and of 40 cm length, coaxial with aluminum pipe 200 and insulated therefrom by a ceramic insulator 218. Electrode 206 may be connected to the plus-terminal of the high voltage source 212; and electrode 208 may be an electrically-conductive rod of nickel-chromium, 1 mm diameter, connected to the negative-terminal of the high voltage source 212. Electrode 208 may be insulated by a ceramic sleeve 220 extending for the complete length of the electrically-conductive rod but terminating short of its tip so that the bare tip of rod 208 defines the airgap 210 with the bare tip of the steel rod 206. As shown in FIG. 1, the steel rod 206 extends substantially coaxially with the aluminum tube 200, whereas rod 208 extends from the high voltage source 212 laterally thereof but is bent in the general axial direction to terminate adjacent the end of rod 206 to define the airgap 210.

Figure 9:
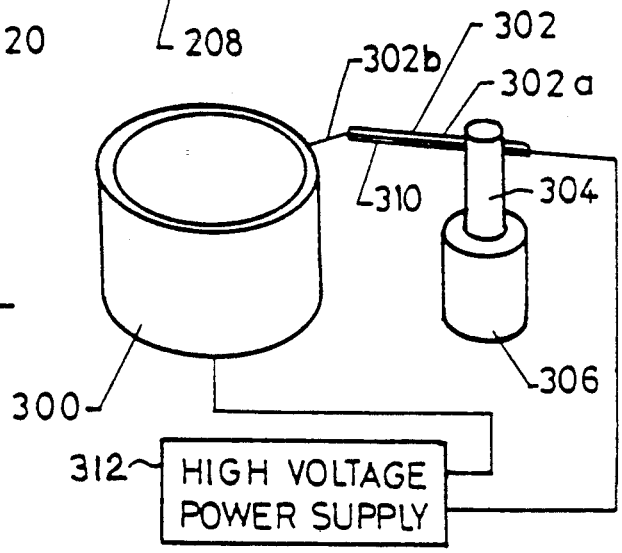
FIG. 9 illustrates another form of apparatus constructed in accordance with the invention for extinguishing a fire that may occur in a container containing an inflammable liquid.

The Embodiment of FIG. 9

FIG. 9 illustrates apparatus for use in extinguishing a fire which may occur in an inflammable liquid in a container 300. In this case, the container 300 is of metal and serves as one of the electrodes of the airgap across which the high voltage is applied to extinguish the flame.

In the apparatus illustrated in FIG. 9, the second electrode of the airgap is shown at 302 and is mounted on a stand 304 supported on a base 306. Stand 304 is vertically adjustable with respect to base 306, and electrode 302 is horizontally adjustable with respect to stand 304. This mounting arrangement thus permits electrode 302 to be adjusted both vertically and horizontally.

Electrode 302 includes a section **302*a* insulated by a layer 310 of suitable insulation material, and a bare section 302*b* at its outer tip overlying the upper end of the metal container 300. The bare tip 302*b* of electrode 302 is inclined downwardly so as to terminate over, but within the periphery of, the container 300 such that the airgap defined by the bare electrode tip 302*b*, and the upper edge of metal container 300**, would be in the vicinity of the base of any fire that may occur within the container.

The high voltage power supply, generally designated 312, is suitably located externally of the container 300 and has one output terminal (e.g., the ground terminal) connected to the metal container 300, and a second output terminal (e.g., the minus-terminal) connected to electrode 302.

As one example, container 300 may be a circular steel fuel container having an inner diameter of about 10 cm and adapted to receive fuel to a level close to the top of the container. Electrode 302 may be a nickel-chromium wire of 1 mm in diameter and insulated by a Pyrex glass sleeve 310. The exposed tip **302*b* of electrode 302 may have a length of about 10 mm and directed at an angle of about 45° towards the longitudinal axis of the container, at a height of about 15–20 mm above the container edge, and about 0–15 mm inside the container periphery. Stand 304** may be of suitable insulating material, such as PVC.

The high voltage power supply 312 may generate either a continuous DC output, or a pulsed DC output, of 20–25 kV, with a minimum duration of about 150 ms. Its minus-terminal may be connected to electrode 302, and its ground-terminal may be connected to metal container 300, or vice versa.

The energization of the high voltage from the power supply 312 may be initiated automatically in response to the detection of a fire by a fire detector (not shown), or manually. The current during an extinguishing operation may be about 100 to 600 microamps.

Figure 10:
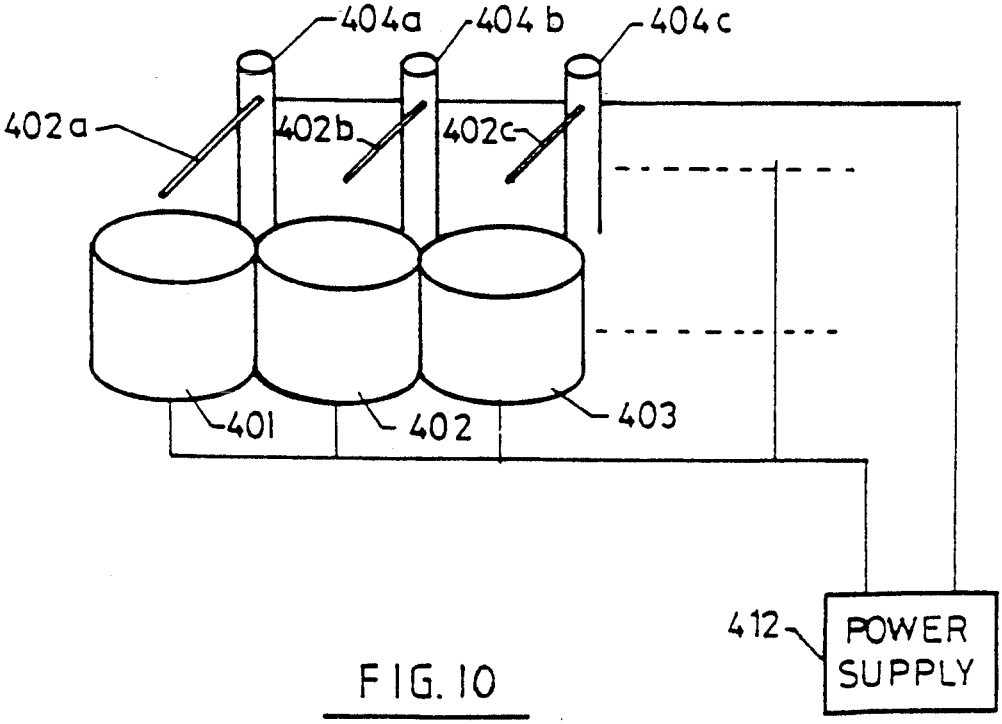
FIG. 10 illustrates the apparatus of FIG. 2 but embodied in a system to protect a plurality of containers containing inflammable liquid.

The Embodiment of FIG. 10

FIG. 10 illustrates the apparatus of FIG. 9 applied to protect a plurality of fuel containers 401, 402, 403. As in FIG. 9, each of the containers 401–403 is also of metal and serves as one electrode of the airgap across which the intense electromagnetic field is produced to extinguish a fire that may occur in the liquid of the container. The second electrode of each such airgap is indicated at 402*a*–402*c*, respectively, and each is supported by a stand 404*a*–404*c* permitting vertical and horizontal adjustment of its respective electrode, as described with respect to FIG. 9. A high voltage supply 412, common to all the containers 401–403, includes an output terminal connected to all the containers, and another output terminal connected to all the second electrodes 402*a*–402*c*, so that all the airgaps are connected in parallel to the high voltage supply.

In all other respects, the multi-container system illustrated in FIG. 10 is constructed and operates in substantially the same manner as described above with respect to FIG. 9.

Figure 11:
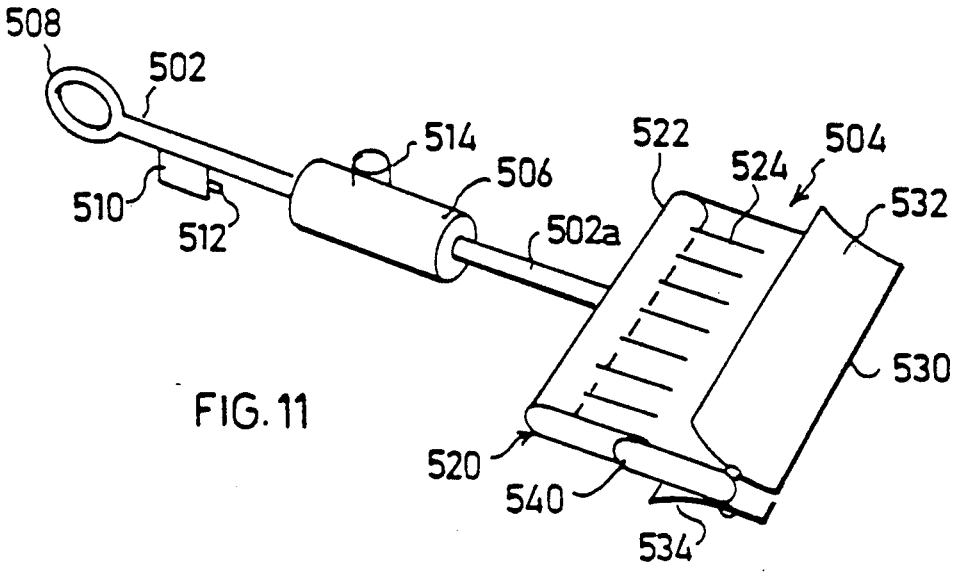
FIG. 11 illustrates another form of apparatus constructed in accordance with the present invention.
Figure 12:
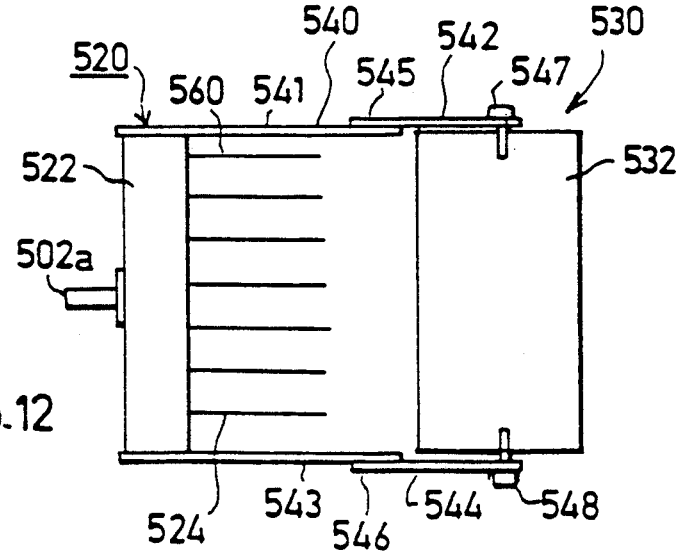
FIG. 12 is a top plan view of the electrode assembly in the apparatus of FIG. 11.

The Embodiment of FIGS. 11–13

The fire extinguishing apparatus illustrated in FIGS. 11–13 is a portable device which may be manually carried by the operator to the location of the fire and then manually operated in order to extinguish the fire. The device includes a handle, generally designated 502, at one end for carrying and manipulating the device; an electrode assembly, generally designated 504, at the opposite end for producing a flow of ionized gas by a corona discharge in air; and a high voltage power supply, generally designated 506, for producing the corona discharge.

More particularly, handle 502 includes two hand-gripping sections 508, 510, to be gripped by the two hands of the operator in order to facilitate carrying and manipulating the device. Hand-grip 510 includes an operator button 512 conveniently located to operate the device.

Power supply 506 includes a source of high voltage which is applied to the electrode assembly 504 upon depression of the operator button 512. The power supply 506 may further include one or more indicator lamps 514 to indicate the status of the device, e.g., a Ready Status, Operating-Status, etc.

The electrode assembly 504 includes two electrode structures, generally designated 520 and 530, respectively, supported in spaced relationship with respect to each other by a plurality of electrically-insulating supporting members, generally designated 540. Electrode structure 520 is connected to one terminal (either the positive or negative terminal) of the high-voltage supply 506, whereas electrode structure 530 is connected to ground, so that when the high voltage is applied between the two electrode structures, a corona discharge is produced to form a flow of ionized particles in a gaseous medium (air) through the end of the electrode assembly 504 opposite to that of handle 502.

Electrode structure 520, connected to the high-voltage terminal of the power supply 506, includes a base electrode 522 of generally concave or V-configuration and a plurality of point electrodes 524 of generally needle configuration fixed in a line along the center line of the base electrode 522. The needle electrodes 524 extend past the base electrode 522 towards electrode structure 530.

Electrode structure 530, which is connected to ground, includes two plate electrodes 532, 534 disposed on opposite sides of the needle electrodes 524 but spaced to one side of those electrodes. The two plate electrodes 532, 534 are curved in a converging manner away from the needle electrodes 524, so that edges 532*a*, 534*a* of the two plate electrodes are more widely spaced apart from each other than their opposite edges 532*b*, 534*b*. Electrode structure 530 thus serves as a funnel or nozzle for receiving the ionized gas produced by corona discharge between the needle electrodes 524 and the plate electrodes 532, 534, and for discharging the flow of ionized gas at an increased velocity through the elongated nozzle opening between the two edges 532*b*, 534*b* of the plate electrodes.

The insulating members 540 for supporting the two electrode structures 520, 530 in spaced relationship include a pair of arms 541, 542 on one side of the electrode assembly 504, and a second pair of arms 543, 544 on the opposite side of the electrode assembly. The two arms 541, 543 are fixed at one of their ends to the base electrode 522 of electrode structure 520, and at their opposite ends they are pivotally mounted by pins 545, 546 to the inner ends of arms 542, 544. The outer ends of arms 542, 544 are pivotally mounted by pins 547, 548 to the two electrode plates 532, 534 of electrode structure 530.

The pivotal mountings 545, 546, 547, 548, permit angular adjustment of the two electrode plates 532, 534 of electrode structure 530 with respect to the needle electrodes 524 of electrode structure 520. Linear adjustment of electrode structure 530, towards and away from electrode structure 520, may be effected by providing the two arms 542, 544 with elongated slots, as shown at 549 in FIG. 13, adjacent to their respective pivotal mountings 545, 546.

The device may be hand-carried to the location of the fire, and its nozzle end (edges 532*b*, 534*b*) may be held above the base of the fire and waved back and forth as the operator button 512 is depressed. The depression of button 512 connects the high-voltage source 506 to the needle electrodes 524 of the electrode assembly 504 to thereby produce corona discharge between the needle electrodes and the two plates 532, 534 of electrode structure 530, connected to ground. The funnel configuration of the two plates 532, 534 increases the velocity of the ionized gas produced by the corona discharge as such ionized gas is discharged from the elongated opening defined by the edges 532*b*, 534*b* of electrode structure 530.

An electrode assembly was constructed as illustrated in FIGS. 11–13, in which the two electrode plates 532 and 534 were 40×7 cm and were spaced apart 5 cm at their wide side and 1.5 cm at their narrow side. Electrode 522 was of a length of 40 cm and a width of 4 cm, and the ends of its diverging sections were spaced 4 cm. The needle electrodes 524 were of a length of 9 cm and had a diameter of 1 mm, and the sharp tips were spaced apart 4 cm. The electrode assembly was connected to a 30 kV 1 mA DC power supply, and was found capable of extinguishing a 30×80 cm flame of hydrocarbon fuels.

The extinguishing of the flame can be enhanced by including another gas, particularly a fire suppressant gas, in the flowable air medium containing the ionizable particles. For example, a small amount of Halon 1301 gas ($CF_3Br$) may be added to the air passed through the electrode assembly subjected to the corona discharge so that the air flow also includes $Br^-$ and $CF_3^+$ ions. When even a small amount of such a gas is added to the air subjected to the corona discharge, the latter ions enhance the fire extinguishing properties of the flowable gaseous medium.

The flowable gaseous medium may also include powders or an aerosal of known fire extinguishing agents, such as mono-amonium phosphate powder, which also enhances the fire extinguishing property of the flowable gaseous medium.

Utilizing a corona discharge for producing the ionized particles will also produce a "flow" or a "wind". This flow can be increased by other means, such as by using a blower, or a compressed source of air, other gas (e.g., halogen), powder, or other flowable gaseous medium carrying the ionized particles to the base of the flame. The additional material is preferably also ionized, but could be non-ionized.

The Embodiment of FIG. 14

FIG. 14 diagrammatically illustrates the invention embodied in apparatus which is fixed relative to the location to be protected from fire and which is automatically operated by a fire detector to generate the ionized gas. Thus, the apparatus illustrated in FIG. 14 includes a fixed electrode assembly, similar to that illustrated in FIGS. 11–13, at each location to be protected from fire, and a plurality of fire detectors 562 which control, via a central processor 564, a high voltage power supply 566 to produce a flow of ionized gas, e.g., by a corona discharge, automatically in response to the detection of a fire at the respective location.

It will also be understood that the invention can be employed together with conventional chemical extinguishing agents or with any other fire suppressant (e.g., inert gases). When employed in this manner, the intensity of a fire may be reduced by the generation and application of the plasma to the base of the fire, permitting the fire subsequently to be extinguished completely by the application of conventional chemical extinguishing agents. Such an arrangement permits a fire to be extinguished with a much lower volume of conventional chemical agents than is possible without the prior application of the externally-generated plasma, thereby permitting the chemical extinguishing agent to be stored in relatively low volume vessels and reducing the resulting cost.

Further variations, modifications and applications of the invention will be apparent.

What is claimed is:

1. A method of extinguishing a fire, characterized in:

generating a gaseous plasma constituted of a body of electrically-charged particles;

and directing said plasma to the base of the fire until the fire is extinguished.

2. The method according to claim 1, wherein said plasma is generated by applying a high voltage between two electrodes separated by an air gap.

3. The method according to claim 2, wherein said high voltage produces a corona discharge between said two electrodes.

4. The method according to claim 1, wherein said plasma is directed to the base of the fire by initially fixing the plasma at a location which would be in the vicinity of the base of a fire should a fire occur.

5. The method according to claim 1, wherein said plasma is directed to the base of the fire by mounting the plasma generator on a portable unit and manually directing the plasma to the base of the fire.

6. The method according to claim 1, wherein a plasma is generated, and the flow velocity of the plasma is increased by directing the plasma via a nozzle to the base of the fire.

7. The method according to claim 6, wherein another flowable medium is injected into the generated plasma to produce a plasma jet which is directed to the base of the fire.

8. The method according to claim 7, wherein said another flowable medium is or includes ionized particles.

9. The method according to claim 7, wherein said another flowable medium is or includes non-ionized particles.

10. The method according to claim 7, wherein said another flowable medium is or includes a fire suppressant material.

11. Apparatus for extinguishing a fire, characterized in that it includes:

a generator for generating a gaseous plasma constituted of a body of electrically-charged particles;

and means for directing said plasma to the base of the fire until the fire is extinguished.

12. The apparatus according to claim 11, wherein said generator includes two electrode structures spaced by an air gap, and means for applying a high voltage to said two electrode structures to produce an electrical discharge therebetween.

13. The apparatus according to claim 12, wherein said two electrode structures are configured to produce a plasma by a corona discharge.

14. The apparatus according to claim 13, further including a nozzle for increasing the flow velocity of the plasma directed to the base of the fire.

15. The apparatus according to claim 13, wherein one of said electrode structures includes at least one point electrode, and said other electrode structure includes a surface electrode spaced from said point electrode.

16. The apparatus according to claim 15, wherein said one electrode structure includes a plurality of point electrodes fixed at one of their ends to a common electrode base with their opposite ends facing said surface electrode of the other electrode structure.

17. The apparatus according to claim 16, wherein said other electrode structure includes two surface electrodes disposed on opposite sides of said point electrodes and spaced to one side thereof, the edges of the two surface electrodes facing the point electrodes being spaced more widely apart from each other than their opposite edges so that their opposite edges define an elongated nozzle opening of relatively small cross-sectional area increasing the velocity of the flow of the plasma between the surface electrodes.

18. The apparatus according to claim 17, wherein said common electrode base of said one electrode structure is of generally concave configuration, and said point electrodes are of generally needle configuration mounted in a line centrally of said concave common electrode base.

19. The apparatus according to claim 13, further including means for injecting another flowable medium into the generated plasma to produce a plasma jet which is applied to the base of the fire.

20. The apparatus according to claim 19, wherein said another flowable medium is a fire suppressant medium.

21. A method of extinguishing a fire, characterized in:

generating an intense electric field;

and directing said electric field to the base of the fire until the fire is extinguished.

22. The method according to claim 21, wherein said electric field is generated by applying a high voltage between two electrodes separated by an air gap.

23. The method according to claim 22, wherein said high voltage produces a corona discharge between said two electrodes.

24. The method according to claim 21, wherein said electric field is directed to the base of the fire by initially locating the electric field at a location which would be in the vicinity of the base of a fire should a fire occur.

25. The method according to claim 21, wherein said electric field is directed to the base of the fire by mounting the electric field generator on a portable unit and manually directing the electric field to the base of the fire.

26. Apparatus for extinguishing a fire, characterized in that it includes:

a generator for generating an intense electric field;

and means for directing said electric field to the base of the fire until the fire is extinguished.

27. The apparatus according to claim 26, wherein said generator includes two electrode structures spaced by an air gap, and means for applying a high voltage to said two electrode structures to produce an electrical discharge therebetween.

28. The apparatus according to claim 27, wherein said two electrode structures are configured to produce a corona discharge.

29. The apparatus according to claim 28, wherein one of said electrode structures includes at least one point electrode, and said other electrode structure includes a surface electrode spaced from said point electrode.

30. The apparatus according to claim 29, wherein said one electrode structure includes a plurality of point electrodes fixed at one of their ends to a common electrode base with their opposite ends facing said surface electrode of the other electrode structure.

* * * * *